US006739548B1

(12) United States Patent
Bittle et al.

(10) Patent No.: US 6,739,548 B1
(45) Date of Patent: May 25, 2004

(54) FIN LOCK SYSTEM

(75) Inventors: David A. Bittle, Decatur, AL (US); Russell S. Garner, Huntland, TN (US); Gary T. Jimmerson, Athens, AL (US); Derek C. Jenkins, Huntsville, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/421,411

(22) Filed: Apr. 21, 2003

(51) Int. Cl.[7] ..... F42B 10/14
(52) U.S. Cl. ..... 244/3.29
(58) Field of Search ..... 244/3.23, 3.24, 244/3.27, 3.29; 102/374, 376

(56) References Cited

U.S. PATENT DOCUMENTS 2,858,765 A * 11/1958 Startzell ..... 244/3.29
3,853,288 A * 12/1974 Bode ..... 244/3.29
4,673,146 A * 6/1987 Inglis ..... 244/3.23
6,186,442 B1 * 2/2001 Bittle ..... 244/3.29

* cited by examiner

*Primary Examiner*—Robert P. Swiatek
(74) *Attorney, Agent, or Firm*—Arthur H. Tiacher; Hay Kyung Chang

(57) ABSTRACT

The fin lock system overcomes the major problems associated with the current deployment and locking mechanism by adding a center boss to the fin between the rear and front bosses and a sliding lock that engages between the housing and the center boss. The sliding lock, having a very low mass, engages with the center boss, and thus with the fin, very quickly and reliably when the fin reaches its fully deployed position, thereby arresting the motion of the fin and preventing it from rebounding. This, in turn, allows the aft-housing lug to lock the fin in its deployed position with one opening motion of the fin. The additional boss provides greater resistance to inertial and aerodynamic loads while the sliding lock completely eliminates both over-rotation of the fin and inconsistent engagement of the fin lock.

10 Claims, 6 Drawing Sheets

FIN LOCK SYSTEM

DEDICATORY CLAUSE

The invention described herein may be manufactured, used and licensed by or for the Government for governmental purposes without the payment to us of any royalties thereon.

BACKGROUND OF THE INVENTION

Currently, a typical tailfin deployment and locking system in a flying object, used to impart stability to the flight of the object, utilizes large aft-housing lug 312 and small forward-housing lug 313. These lugs are located on housing 201 of flying object 101 and serve the purpose of reducing the housing area required to attach and deploy fin 202. The fin itself has, extending from its body, rear boss 309 and front boss 311 which work in conjunction with the housing lugs to lock the fin in position once the fin has reached the desired deployment position. More specifically, combination torsion/compression spring 204 acts between the fin and the housing to rotate the fin from its initial folded position on the housing to its deployed position and to lock the fin against the aft-housing lug. A rebound stop formed into the aft-housing lug prevents over-rotation of the fin.

An example of such fin deployment and locking system usage can be found in the multiple submunitions which are commonly referred to as "BATs" and are carried in the Army Tactical Missile System (ATACMS) missile 100 as shown in FIGS. 1A and 1B. As stated above, currently, in the BATs, or other similar flying objects 101, a combination spring is used which provides both the torsion and compression spring functions. The combination spring is made from multiple turns of a steel music wire of a given diameter to generate the desired in-lb/degree of torque and lb/in of compression. The torsional effect of the spring rotates the fin to open to deploy it from its closed or folded position while the compressional effect holds the deployed fin in its deployed position against the fin stop. The fin stop is small flat shelf 314 on the aft-housing lug designed to stop the rotation of the fin by engaging a cut-away area (not shown in the drawings) on the fin's rear boss and prevent the fin from rebounding. But the forces generated during the initial impact of the fin with the shelf frequently overcome the spring forces, causing the fin to rebound before finally locking into its deployed position. The small forward-housing lug acts as a guide to keep the leading edge of the fin aligned correctly during deployment and in the correct position during flight of the object, but is not intended to be a load-carrying member.

The current state of the art in fin deployment and locking system as described above with respect to the BAT as an example suffers from two major problems: The first is that the fin does not reliably slide aft, this failure causing a corresponding failure on the part of the cut-away area (not shown in the drawings) on its rear boss to engage the shelf on the aft-housing lug on the initial deploying stroke of the fin. This absence of reliability allows the fin to rebound from the shelf as many as two or three times before the fin slides aft enough to engage the locking mechanism. In an aerodynamic environment, such repeated rebounds can promote fracture of the fin root and even cause loss of control of the flying object; the second problem, closely related to the first, is the lack of sufficient strength in the forward-housing lug to withstand the additional forces imposed on it by the repeated rebounds of the fin. The forward-housing lug is not designed to carry any load.

SUMMARY OF THE INVENTION

The improved fin lock system overcomes the major problems associated with the current deployment and locking mechanism by adding a center boss to the fin between the rear and front bosses and a sliding lock that engages between the housing and the center boss. The sliding lock, having a very low mass, engages with the center boss, and thus with the fin, very quickly and reliably when the fin reaches its fully deployed position, thereby arresting the motion of the fin and preventing it from rebounding. This, in turn, allows the aft-housing lug to lock the fin in its deployed position with one opening motion of the fin.

The actuation of the fin is accomplished by a torsion spring that rotates the fin to the deployed position and a compression spring that moves the fin into the locked position. The addition of the center boss and sliding lock not only provides a secure locking but also increases the strength of the fin by preventing the fin from over-rotating, thereby reducing the bending moment on the fin. Further, the stresses on the aft-housing lug are reduced by the center boss's additional support of the fin.

DESCRIPTION OF THE PREFERRED EMBODIMENT

Figure 1B:
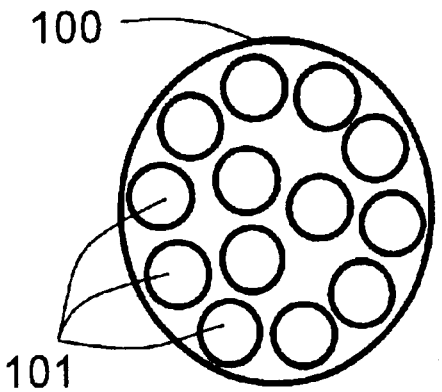
FIG. 1B shows a cross-sectional view of 13 BATs being carried inside an ATACMS missile.
Figure 1A:
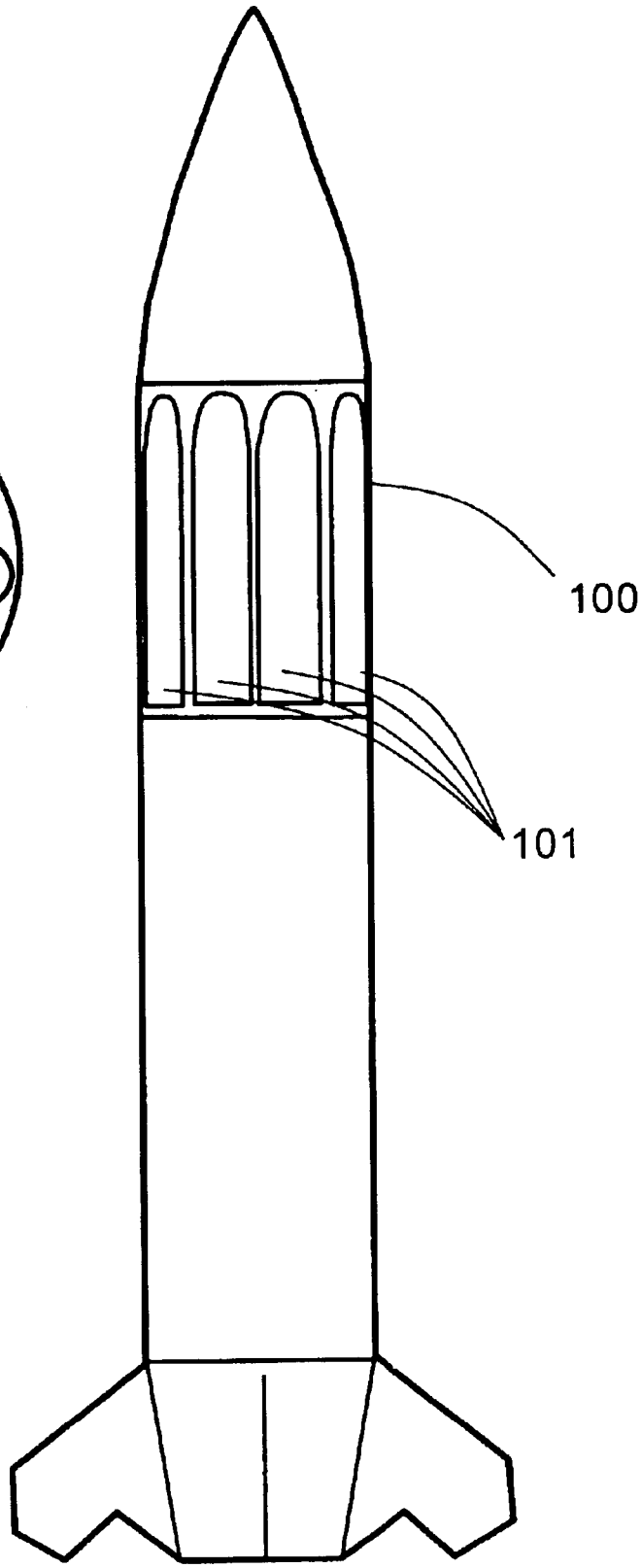
FIG. 1A is a diagram of a side view of an Army Tactical Missile System (ATACMS) missile carrying BAT submunitions.
Figure 2A:
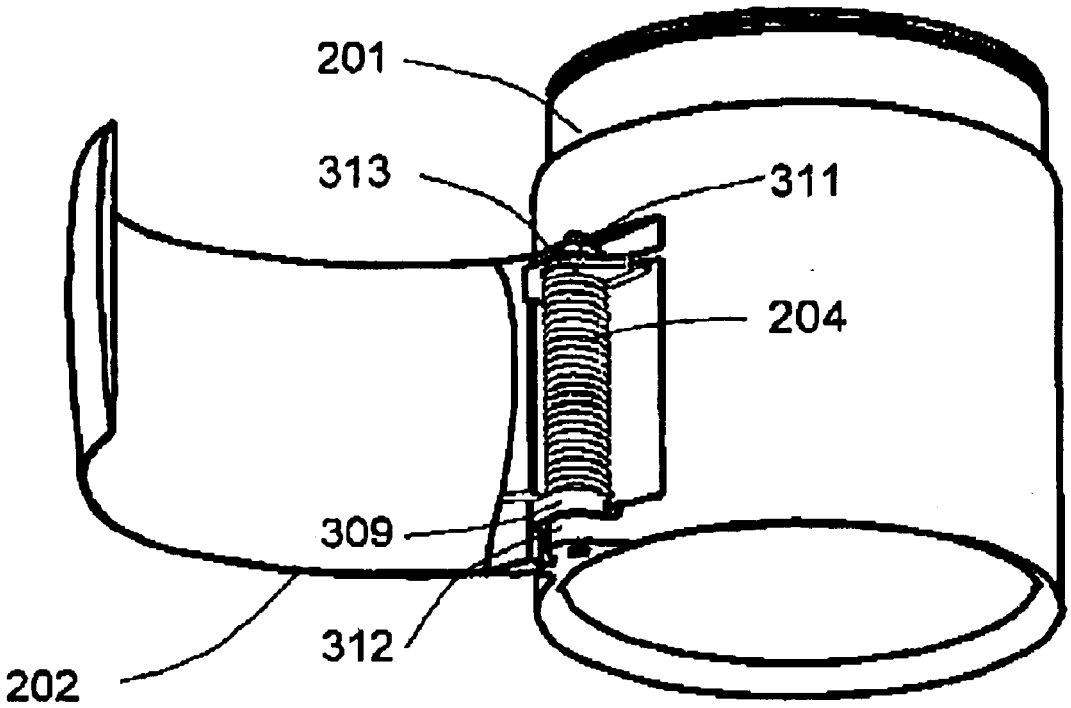
Prior Art FIGURE 2A
FIG. 2A shows a flying object with its fin fully deployed using the prior art baseline tailfin lock.
Figure 2B:
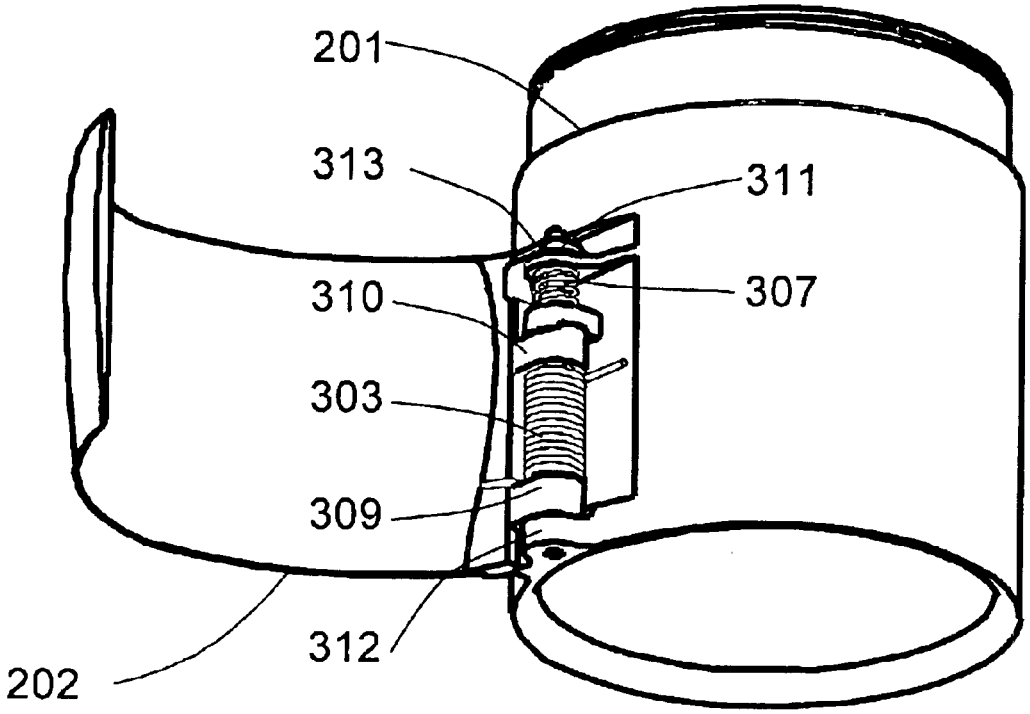
FIG. 2B shows a flying object with its fin fully deployed using the improved tailfin lock.

Referring now to the drawing wherein like numbers represent like parts in each of the several figures, the construction and the operation of the improved fin lock system is explained in detail. The improved fin lock system is shown in its assembled state in FIG. 2B coupled between housing 201 of the flying object and fin 202. Even though FIG. 2B shows only one fin, it is for illustrative purposes only and the flying object is envisioned as having multiple such fins, distributed along the circumference of the housing at equal intervals. As is well known, such an arrangement imparts balance and stability to the object during its flight.

Figure 3:
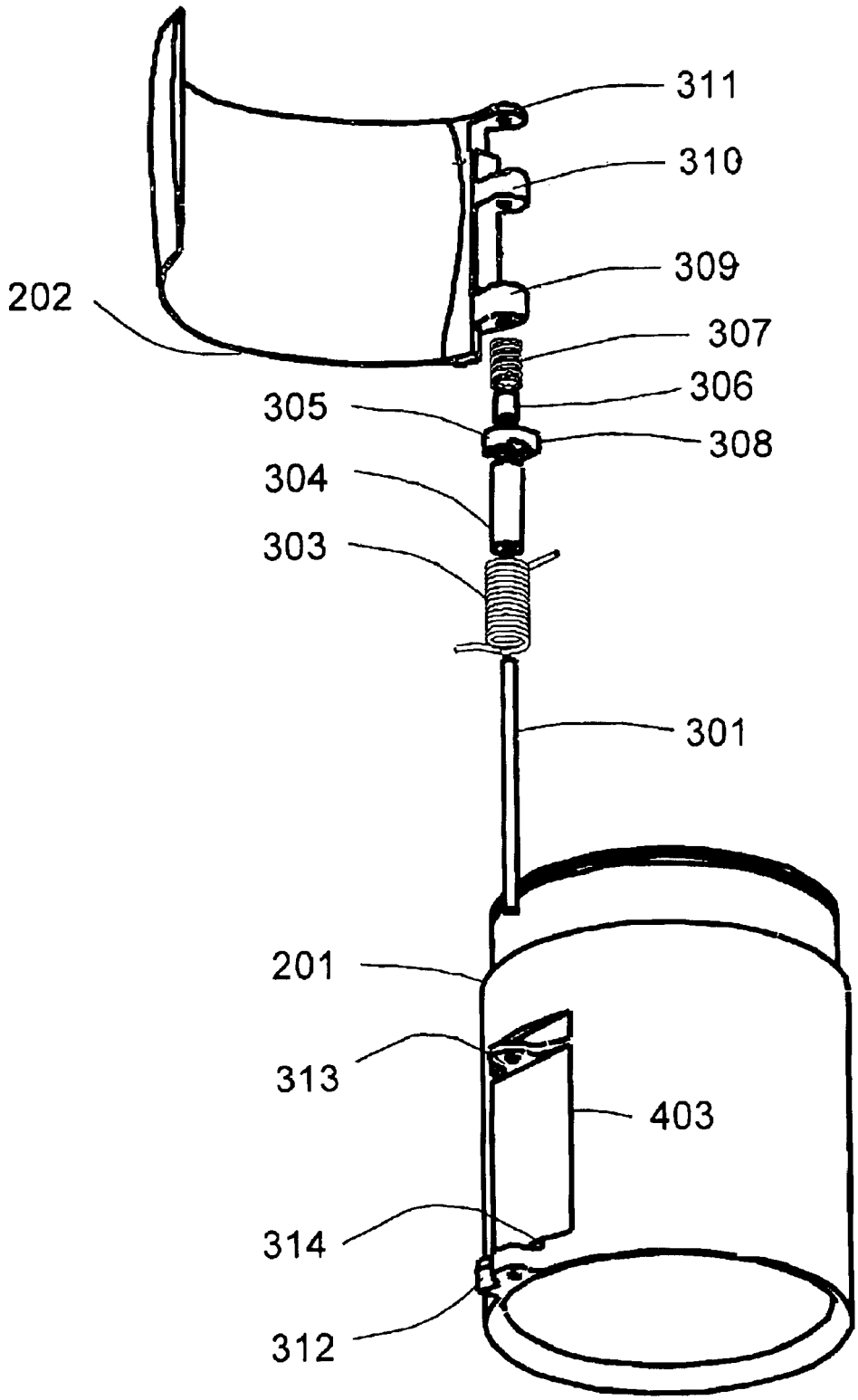
FIG. 3 presents an exploded view of the improved tailfin lock in its preferred embodiment.
Figure 4:
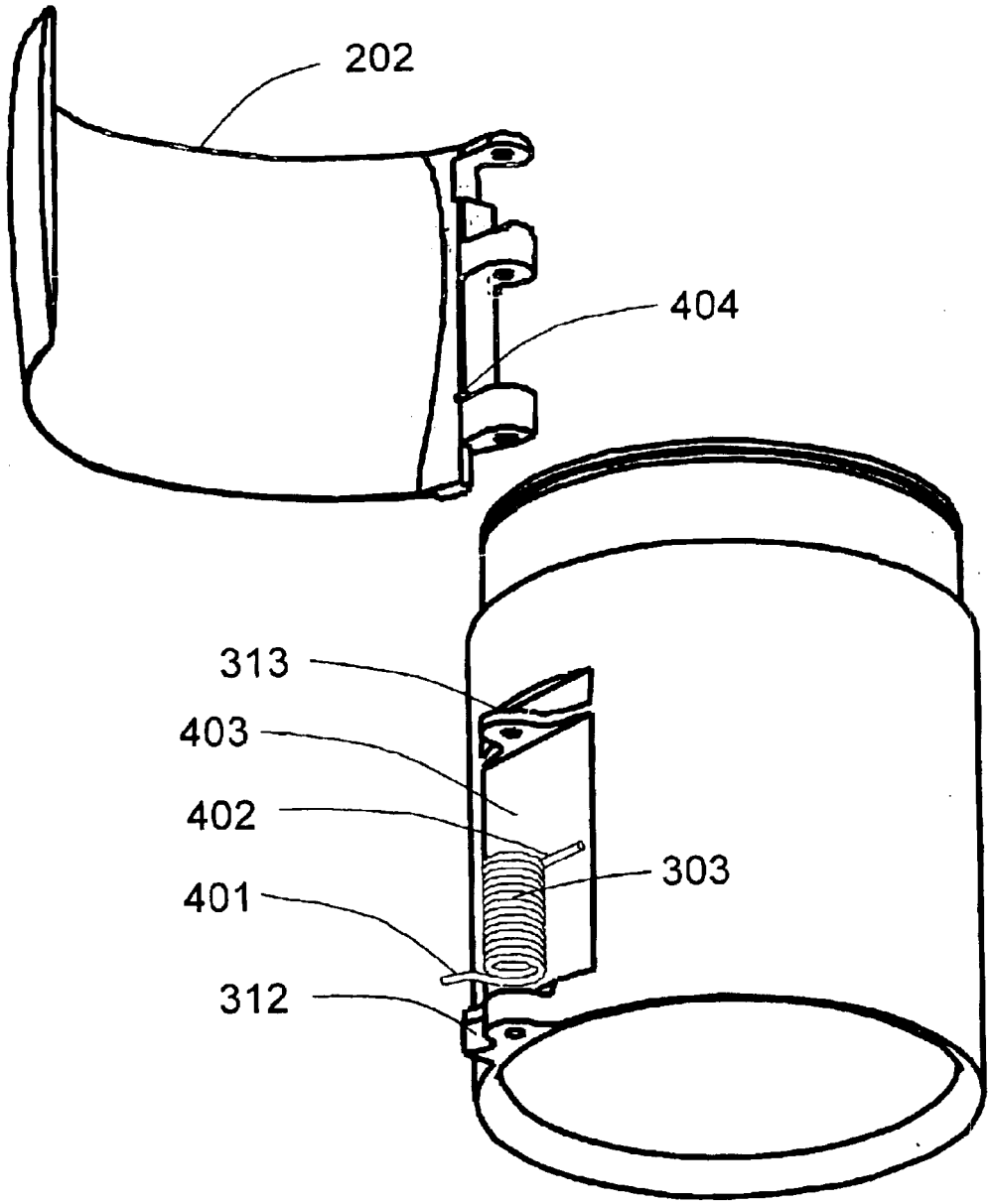
FIG. 4 illustrates positioning of the torsion spring on the flat area of the housing.

As shown in FIG. 3, the improved fin lock system comprises multiple springs, a spacer for each of the springs, sliding lock 305 having special features and axle shaft 301 all of which cooperate with housing lugs and bosses extending from the fin to accomplish a more controlled and smooth deployment and locking of fin 202. The improved fin lock system achieves secure locking of the fin in its deployed state with one deploying motion and without repeated rebounding of the fin before the fin reaches the final desired deployed position.

Initially, fin 202 is held flush against the housing of the flying object by a flexible strap (not shown in the drawings).

Figure 5:
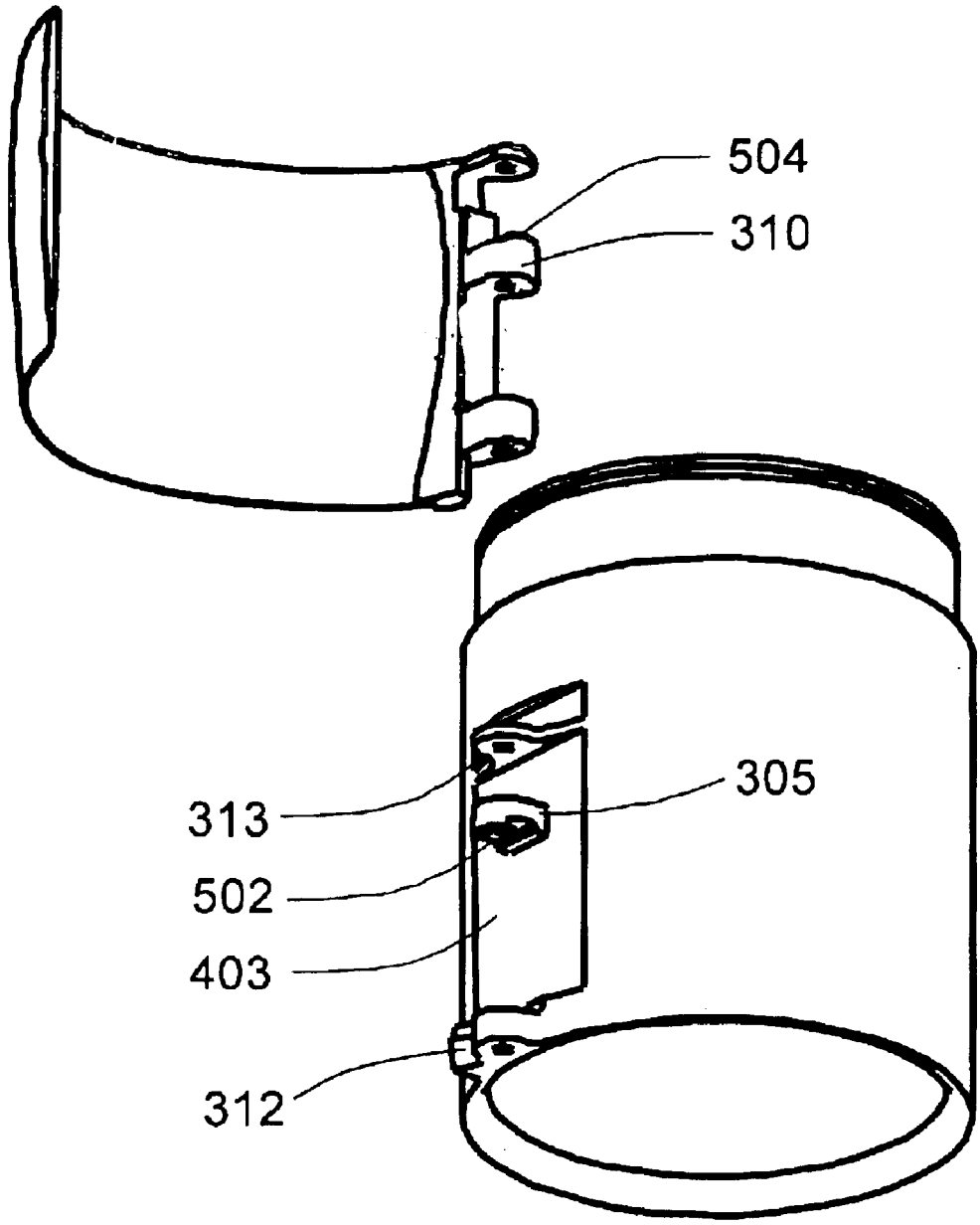
FIG. 5 illustrates in detail the tooth on the center boss and the slot in the sliding lock.

When the strap is cut by any suitable means at the desired point in time, the torsional force of second spring arm 402 of torsion spring 303 acts on flat surface 403 (bordered by aft-housing lug 312 and forward-housing lug 313) and the torsional force of first spring arm 401 acts on spring notch 404 of fin 202 to rotate the fin open toward a pre-selected deployment angle. As the fin nears the deployment angle, tooth 504 on center boss 310 comes into alignment with slot 502, which has been machined into sliding lock 305, as shown in FIG. 5, and is of the shape and depth to accommodate therein the tooth. Compression spring 307 then acts upon the face of forward-housing lug 313 and the sliding lock to engage the slot with the tooth, leading the sliding lock to lock fully onto center boss 310 during the initial opening stroke of the fin. When the sliding lock has thus fully engaged, the rotational motion of torsion spring 303 and the sliding lock cause flat bottom side 308 of the sliding lock to make contact with flat surface 403. As the flat bottom side 308 bears against flat surface 403, there is no further rotational movement of the sliding lock. This cessation of the rotation of the sliding lock also causes the rotational motion of the fin to be arrested. Concurrently, the cut-away area (not shown in the drawings) on the fin's rear boss impacts shelf 314 on the aft-housing lug. When the fin rotation is thusly arrested, the fin and sliding lock are together forced aft by compression 307 to make immovable contact with aft-housing lug 312. The natural rebounding motion of the fin is restricted by the full engagement of the sliding lock with center boss 310, so that the entire assembly slides onto the aft-housing lug much more easily and reliably than it would without the sliding lock, its slot, the center boss and tooth.

The components comprising the improved fin lock system, namely, lugs, bosses, springs and sliding lock, host holes and openings that run centrally through them and enable the components to be joined rotatably and linearly as shown in the drawings by axle shaft 301 that passes through the holes and the openings. The improved fin lock system may also comprise first and second spacers 304 and 306, which are placed inside torsion spring 303 and compression spring 307, respectively, to give the springs support and keep them properly aligned with respect to other components of the fin lock system. The spacers also have holes centrally therethrough along their length to accommodate the axle shaft.

Suitable materials for the components of the improved fin lock system include resin and fiber composites, aluminum alloys, beryllium alloys or other lightweight materials. Some desirable lightweight materials are lightweight thermoplastic for low cost and strength, corrosion resistance, dimensional stability and ease of manufacture. The springs should be made from high-quality metallic spring alloys.

Although a particular embodiment and form of this invention has been illustrated, it is apparent that various modifications and embodiments of the invention may be made by those skilled in the art without departing from the scope and spirit of the foregoing disclosure. For example, if space is at premium, the torsion spring can be made of square wire to reduce the length of the spring while serving the same purpose as a spring made of round wire. Accordingly, the scope of the invention should be limited only by the claims appended hereto.

We claim:

1. In a flying object having a housing therearound and a plurality of fins, said fins being initially in folded positions on said housing but being deployable from said folded positions, a locking assembly for coupling each of said fins with said housing for easily locking and securely maintaining said each fin in its locked position upon deployment of said each fin so as to render stability to said object during its flight, said locking assembly comprising: a forward-housing lug and an aft-housing lug, said lugs each having a hole therethrough and being fixedly formed on said housing; at least a rear boss, a front boss and a center boss therebetween, each of said bosses having a hole therethrough and said center boss further having thereon a tooth and said rear boss being positioned adjacent to said aft-housing lug while said front boss is positioned adjacent to said forward-housing lug, said bosses extending from said each fin; a torsion spring positioned next to said rear boss, said torsion spring being rotatable to deploy said fin; a sliding lock having a slot and a hole therethrough, said lock further having a flat bottom side, said slot being of a shape and depth to accommodate therein said tooth of said center boss; a compression spring positioned between said sliding lock and said forward-housing lug, said compression spring causing said sliding lock to engage with said tooth upon deployment of said fin; and a means for rotatably and linearly joining said lugs, bosses, springs and sliding lock, said lugs, bosses, springs and sliding lock cooperating with each other so as to allow said each fin to deploy smoothly from its folded position and lock with certitude as soon as said fin reaches a pre-selected deployment angle without rotating beyond said deployment angle.

2. A locking assembly as set forth in claim 1, wherein said assembly further comprises a first spacer placed inside said torsion spring and a second spacer placed inside said compression spring, said spacers having holes therethrough along the lengths thereof and maintaining the alignment of said springs.

3. A locking assembly as set forth in claim 2, wherein said holes hosted in said lugs, bosses, sliding lock and spacers are centrally located in their respective hosts.

4. A locking assembly as set forth in claim 3, wherein said linearly joining means is an axle shaft passing through said holes in said lugs, bosses, spacers and sliding lock.

5. A locking assembly as set forth in claim 4, wherein said assembly still further comprises a flat surface area on said housing, said flat area being bordered by said aft-housing and forward-housing lugs.

6. A locking assembly as set forth in claim 5, wherein said fin's reaching said pre-selected deployment angle coincides with said flat bottom side of said sliding lock making an immovable contact with said flat surface area on said housing so as to prevent any further rotation of said fin beyond said pre-selected deployment angle.

7. In a flying object having a housing therearound and deployable fins, said fins being initially in folded positions on said housing but being deployable from said folded positions, each of said fins having a rear boss and a front boss protruding therefrom, each of said bosses having a hole centrally therethrough and said housing having thereon an aft-housing lug and a forward-housing lug to cooperate with each fin, said lugs each having a hole centrally therethrough and being fixedly formed on said housing, a locking assembly for coupling each of said fins with said housing to provide easy locking and secure maintenance of said each fin in its locked position upon full deployment of said each fin from its folded position so as to render stability to said flying object during its flight, said locking assembly comprising: a flat surface area on said housing, said flat area being bordered by said housing lugs; a center boss extending from said each fin, said center boss being located between said rear and front bosses and having a hole centrally therethrough and a tooth thereon; and a means for connecting said lugs and said bosses so as to allow said fin to deploy smoothly from its folded position and lock with certitude as soon as said fin reaches a pre-selected deployment angle without rotating beyond said deployment angle.

8. A locking assembly as set forth in claim 7, wherein said connecting means comprises: a torsion spring positioned next to said rear boss, said torsion spring being rotatable to deploy said fin; a sliding lock having a slot and a central hole therethrough, said lock further having a flat bottom side, said slot being of a shape and depth to accommodate therein said tooth of said center boss; a compression spring positioned between said sliding lock and said forward-housing lug, said compression spring causing said slot in said sliding lock to engage with said tooth upon deployment of said fin, thereby locking said fin in its deployed position; and a means for rotatably and linearly joining said lugs, bosses, springs and sliding lock.

9. A locking assembly as set forth in claim 8, wherein said fin's reaching said pre-selected deployment angle coincides with said flat bottom side of said sliding lock making an immovable contact with said flat surface area on said housing so as to prevent any further rotation of said fin beyond said pre-selected deployment angle.

10. A locking assembly as set forth in claim 9, wherein said linearly joining means is an axle shaft passing through said holes in said lugs, bosses and sliding lock.

* * * * *